US012017329B2

(12) United States Patent
Neff

(10) Patent No.: US 12,017,329 B2
(45) Date of Patent: Jun. 25, 2024

(54) GRINDING WHEEL WITH DIFFERENT WORK SURFACES

(71) Applicant: Friction Coating Corporation, Clinton Township, MI (US)

(72) Inventor: Charles Neff, Clinton Township, MI (US)

(73) Assignee: Charles Neff, Clinton Township, MI (US)

( * ) Notice: Subject to any disclaimer, the term of this patent is extended or adjusted under 35 U.S.C. 154(b) by 657 days.

(21) Appl. No.: 16/723,919

(22) Filed: Dec. 20, 2019

(65) Prior Publication Data

US 2021/0187701 A1 Jun. 24, 2021

(51) Int. Cl.
*B24D 5/14* (2006.01)
*B24D 18/00* (2006.01)

(52) U.S. Cl.
CPC ..... *B24D 5/14* (2013.01); *B24D 18/00* (2013.01)

(58) Field of Classification Search
CPC ... B24D 5/14; B24D 5/00; B24D 5/02; B24D 5/06; B24D 5/063; B24D 5/066; B24D 18/00
USPC ..... 451/541, 548, 542
See application file for complete search history.

(56) References Cited

U.S. PATENT DOCUMENTS 3,916,581 A * 11/1975 Messier ..... B24B 53/053 451/72
4,942,695 A * 7/1990 Wedeniwski ..... B24B 1/00 451/46
5,228,241 A * 7/1993 Ohta ..... B24B 5/04 451/49

* cited by examiner

*Primary Examiner* — Phong H Nguyen
(74) *Attorney, Agent, or Firm* — Leydig, Voit & Mayer, Ltd.

(57) ABSTRACT

An abrasive tool includes a tool base having a supporting surface and a generally cylindrical abrasive surface layer disposed on the supporting surface. The abrasive surface removes material from a work-piece outer surface by contact therewith and by relative movement along a defined working path. The abrasive tool comprises a first axially extending circumferential portion featuring an abrasive coating selected to produce a final finish on the work piece, and a second trailing portion that tapers radially inwardly to accommodate post-grind radial expansion of the work piece.

9 Claims, 14 Drawing Sheets

GRINDING WHEEL WITH DIFFERENT WORK SURFACES

FIELD OF THE INVENTION

The present disclosure generally relates to high friction surfaces for use in abrasive removal applications, and more particularly, to an abrasive tool for producing a high quality surface finish with the use of abrasive textured portions presenting different working planes for finishing a work piece.

BACKGROUND OF THE INVENTION

Grinding wheels are used in various applications. For example, they are often used to facilitate the grinding of feed rollers of the type used in printing operations. Such feed rollers advance a paper web through a series of sequential operations of the printing process. A feed roller of this general type is typically a cylindrical shaped structure having an outer cylindrical portion constructed from a compliant material such as natural rubber or a synthetic polymer. The outer cylindrical portion covers a steel core. Through repeated usage, the feed roller outer surface becomes worn. This necessitates resurfacing and/or replacement of the outer cylindrical portion of the roller. If the wear is minimal, a small portion of the compliant layer can be removed in a controlled fashion to refresh the surface characteristics. On the other hand, if the wear on the roller outer surface is more extreme, the compliant layer must be removed from the core and replaced.

In both instances, the dimension and surface finish of the compliant roller outer cylindrical surface are worked by a controlled manufacturing process. More specifically, a grinding process is typically employed to remove material from the outer cylindrical surface of the roller. The type of grinder used in such an operation is an outside diameter (O.D.) grinder. An "O.D. grinder" is a term of art used to describe a piece of equipment or an operation in which a rotationally symmetrical work piece, such as the roller, may be machined. The roller is held while it is rotated about its longitudinal axis as a grinding wheel rotating about a parallel axis is engaged with the compliant outer cylindrical surface as it traverses axially there along. In this manner the axis of rotation of the compliant outer cylindrical surface is trued up to the axis of the core. In addition, the outermost diameter of the compliant portion and the surface finish characteristics of the roller are established.

During the grinding process as a grinding wheel comes into engagement with the compliant material the compliant material is deformed out of its unstressed shape. Typically the portions in contact with the grinding wheel experience a reduced radial dimension. This distortion of shape is relieved once the grinding operation is completed. As the complaint material returns to its unstressed shape it expands coming into contact with the trailing edge of the grinding wheel. The outermost circumferential portion of a grinding wheel is designed to produce a high-quality finish whereas the trailing edge of the grinding wheel heretofore is not. Consequently, the surface finish quality produced by the outermost circumferential portion of a grinding wheel is impaired by contact with the trailing edge of the grinding wheel. The damage appears as scratches on an otherwise smooth surface. Such a phenomenon may be observed by performing a test comparing the surface finish of the compliant material after two alternative grinding operations. For example, a plunge only, grind will feature a surface finish produced by the outer circumferential portion of a grinding wheel whereas a plunge and traverse grind will cause the previously described phenomena to occur with the trailing edge of the grinding wheel producing scratches on an otherwise smooth finish.

SUMMARY

The present disclosure includes a grinding wheel for finishing a work piece such as a feed roller having a compliant outer cylindrical surface. The grinding wheel has first and second circumferential portions of abrasive coating disposed thereon. The first portion includes a first axially extending portion with an abrasive coating selected to produce the final finish on the outer cylindrical surface of the roller. A second trailing portion is disposed on the grinding wheel axially adjacent to the first portion and downstream of the first portion with respect to the travel of the grinding wheel relative to the outer cylindrical surface of the roller. The second portion tapers radially inwardly away from the roller outer surface by a dimension that accommodates post-grind radial expansion of the compliant material as it is worked by the grinding wheel. The abrasive coating disposed on first and second circumferential portions are substantially identical.

In this manner, the grinding wheel traverses along the outer cylindrical surface of the work piece. The grinding wheel structure provides an improved surface finish by presenting a trailing edge that controls engagement of the ground surface of the work piece as the work piece expands.

In another aspect, this disclosure relates to a method for making an abrasive tool providing a high quality surface finish to a work piece. The method includes first providing a tool base defining an outer supporting cylindrical surface presenting a first axially extending circumferential portion and a second axially extending circumferential portion, located adjacent to the first axially extending portion. Next, an abrasive surface layer is applied to the first and second axially extending portion to provide first and second abrasive surfaces. The method then applies a first dressing operation to a first axially extending abrasive surface portion to define a first working plane. Thereafter, the method applies a second dressing operation to the second axially extending abrasive surface portion, located downstream of the first axially extending portion. The second axially extending abrasive surface portion defines a second working plane that tapers radially inwardly relative to the first abrasive surface portion by a dimension that accommodates post-grind radial expansion of the work piece outer surface.

It should be understood that the drawings are not necessarily to scale. In certain instances, particular details have been enlarged in order to provide further clarity in the disclosure.

DETAILED DESCRIPTION

The present disclosure relates to an abrasive surface applied to an outer peripheral surface of a grinding wheel. The grinding wheel outer surface is constructed to present at least two work surface planes. A first work surface is dressed to define a first working plane for providing a finish to the work piece. A second work surface, disposed downstream from the first work surface, has an axially extending profile that tapers inwardly such that it defines a second working plane, different from the first working plane. The second work surface facilitates a high quality finishing operation on the work piece by accommodating a radial expansion of the work piece as it is traversed by the grinding wheel. In a preferred embodiment, the work piece is the outer cylindrical surface of a feed roller having a compliant material covering. As the compliant material covering relaxes from a worked state to an unworked state, the second working plane accommodates the radial expansion so as not to impair the finish produced by the first working plane.

Figure 1:
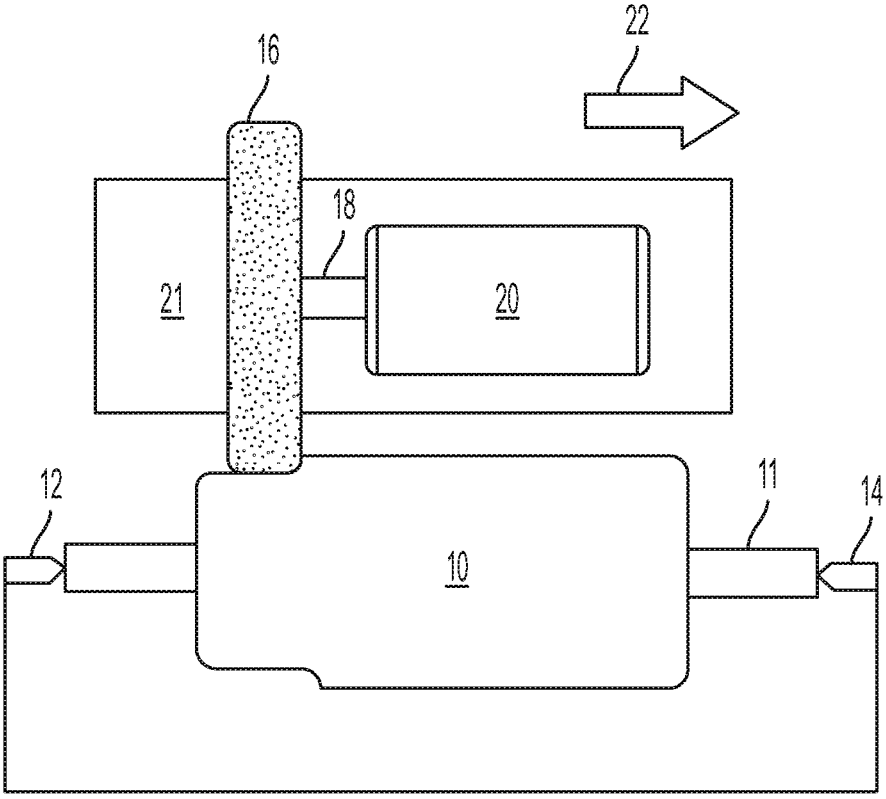
FIG. 1 is a schematic view of an OD grinding apparatus and operation.

Feed rollers used in paper making and other web feeding apparatus often include an outer cylindrical surface covered with a compliant material. While it works satisfactorily for its intended purpose, the compliant material becomes worn over extended use. The outer cylindrical surfaces are often reworked or renewed with the use of an OD grinder to remove the worn portion. FIG. 1 generally shows suitable apparatus for performing an OD grinding operation of this general type. An elongated cylindrical work piece (e.g., a feed roller used in a web feeding apparatus) 10 has a central drive shaft 11 placed between centers 12 and 14 and rotated. A grinding wheel 16 is mounted for rotation on a shaft 18 by a motive means such as electric motor 20. The motor, shaft and wheel are mounted to a carriage 21 that provides translation in the direction indicated by arrow 22. As illustrated in FIG. 1, the grinding wheel 16 moves to the right to perform the resurfacing operation on the feed roller 10. In this manner, the worn portion of roller 10 is removed leaving the outer cylindrical surface smooth. A similar procedure is often used to prepare the surface of rollers of this general type during manufacturing.

Figure 4:
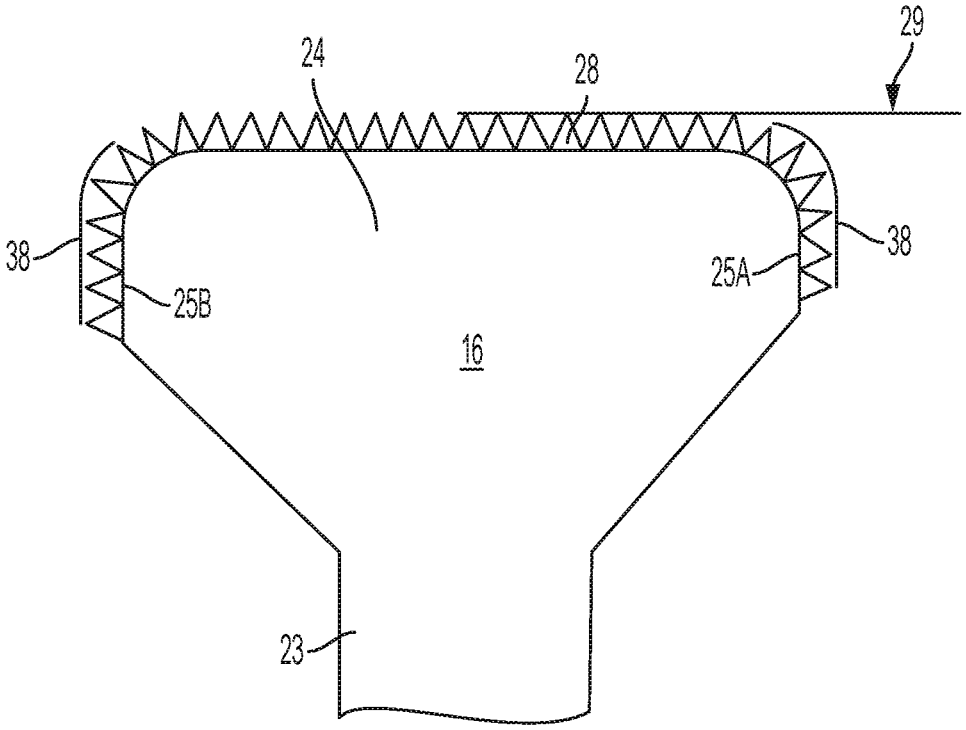
FIG. 4 is a prior art grinding wheel shown in cross section.

The grinding wheel 16 comprises an inner hub 23 surrounded by an outer rim 24 (see FIG. 4). The outer rim 24 has an abrasive coating 28 suitable to grind the outer roller cylindrical surface of the paper roller. Neff U.S. Pat. No. 5,181,939, incorporated herein by reference, discloses a suitable abrasive coating in which pinnacles of tungsten carbide are brazed to the rim of a steel grinding wheel. More specifically, the desired texture of the abrasive coating surface may be formed on an abrasive surface using a magnetic flux concentration. To do so, a fixture is employed that includes a generally planar magnetized base surface with protrusions formed thereon to provide a mosaic surface. The protrusions are machined into the surface or applied to the surface in the form of discreet elements such as steel balls. A release mechanism or covering layer is then applied over the mosaic surface. The release mechanism may take the form of a thin coating of silicone or a thin sheet of polymeric material (such as Teflon).

Magnetizable abrasive particles are diffused onto the surface of the release mechanism. The particles orient themselves along the lines of magnetic flux to form generally cone-shaped elements or stacks having generally triangular cross sections. The stacks define a working surface for a tool. If small steel balls are used, conical structures or cones will form at the locations of magnetic flux concentration through the balls.

A coat of acrylic paint is then applied to the elements to provide structural integrity. After the paint has dried or solidified, a braze paste consisting of a binder mixed with braze alloy is applied to encapsulate the cones and form a structural interconnection or flexible support web between the cones to maintain the cones in preselected positions on a flexible web before brazing.

After the braze paste binder has dried or solidified, the entire matrix may be removed from the base fixture leaving the balls or other projections in place for further use. The abrasive element matrix may then be cut to a desired shape. The release mechanism may then be removed from the matrix and the matrix may be secured to another base structure such as a tool form having a smooth surface by application of an acrylic adhesive. The acrylic adhesive is brushed on the matrix or the base structure or in the alternative may be preinstalled and protected by a release liner. The assembly of matrix and base structure is then placed in a braze furnace and heated to the necessary brazing temperature while maintaining a controlled atmosphere such as hydrogen or a substantial vacuum. The braze alloy joins the cones in a solid structure or pattern after brazing. After the brazing process has been completed, the assembly will feature a high friction surface which may be used as an abrasive tool.

Figure 2:
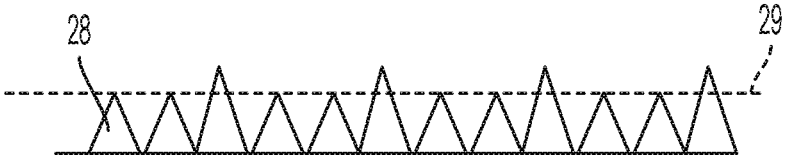
FIG. 2 is a cross section view of an abrasive coating used in the present disclosure shown in a pre-dressed condition.
Figure 3:
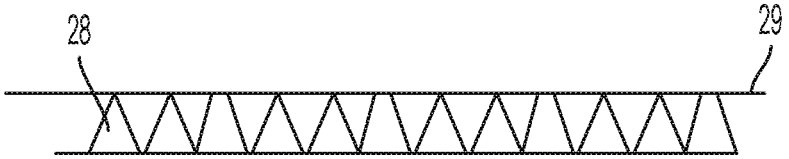
FIG. 3 is another cross section view of the abrasive coating of the present disclosure shown in a dressed condition.

Such a coating 28 is diagrammatically illustrated in cross section in FIGS. 2 and 3. As shown in FIG. 2, the height of individual pinnacles which form the coating 28 may vary in a range of a few thousandths of an inch above or below a target height (denoted by a line 29 shown in FIG. 2). For example, a typical coating 28 may be comprised of pinnacles spaced apart by 0.060 inches with a pinnacle height ranging from 0.048 to 0.052 inches.

It has been found that the surface finish quality of such a coating is a function of the quantity of pinnacles per square inch having an identical height. Therefore, a dressing operation is preferably used to grind down taller pinnacles to a target height in order to improve the quality of a ground surface finish. For example, in the coating previously described, any pinnacle extending above 0.050 inches in height would be ground away to a height of 0.048 inches. On the other hand, those pinnacles having a height of 0.048 inches are not ground away as a result of the dressing operation in a preferred embodiment. As shown in FIG. 3, such a dressing operation is used to define a single working plane 29 of the abrasive coating 28.

Figure 5:
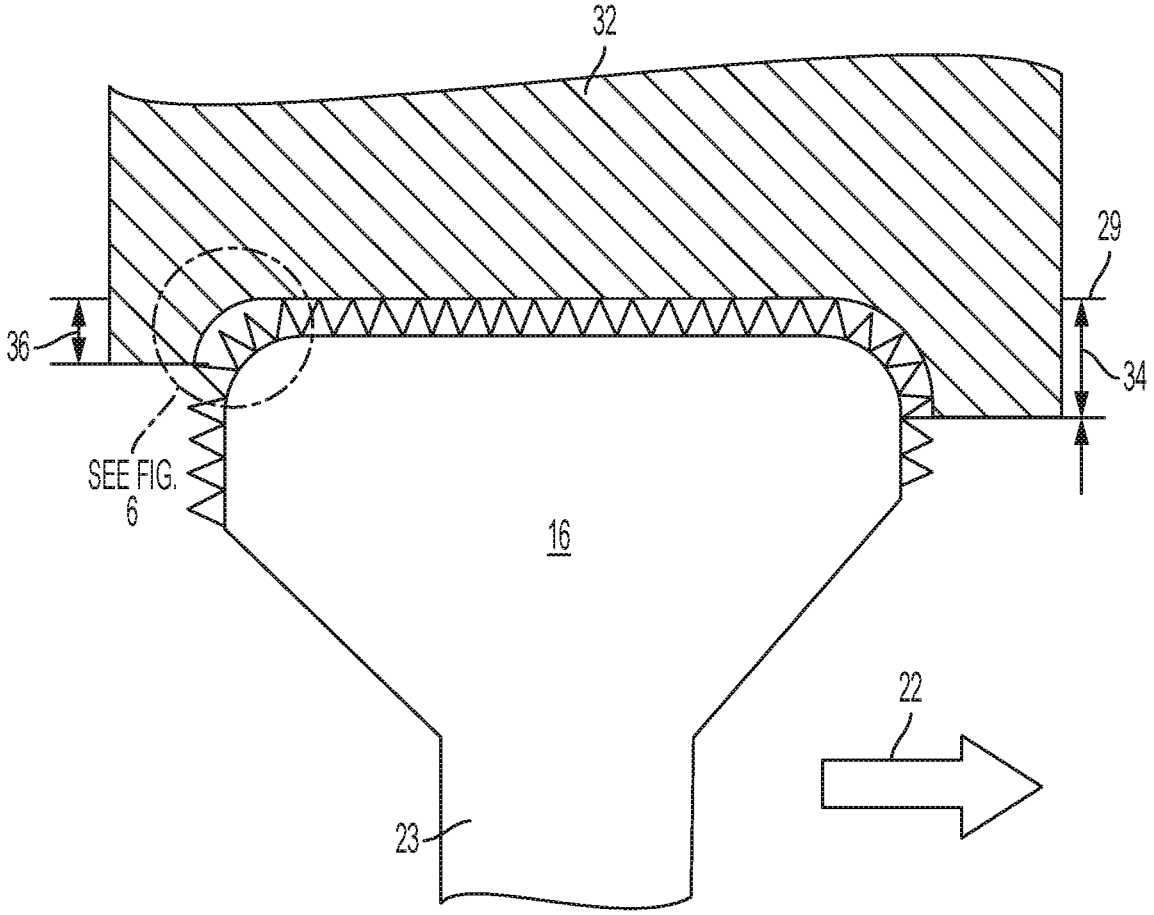
FIG. 5 is the grinding wheel of FIG. 4 engaged in an OD grinding operation.

FIGS. 4 and 5 illustrate a prior art grinding wheel 16 formed by the process described above. The illustrated grinding wheel 16 has an outside circumferential surface of its rim 24 coated with abrasive coating 28. The coating 28 having been dressed to define working plane 29, as will be understood by those skilled in the art. The abrasive coating 28 extending beyond working plane 29 comprises undressed coating portions 38, 38 disposed at opposite sides of the working plane 29. That is, the outer surface of the rim 24 is rounded such that it defines opposed side walls 25A, 25B on which the abrasive coating 28 will also extend. As shown in FIG. 5, the outer cylindrical surface 32 of the feed roller (or work piece) is worked by the grinding wheel 16 by relative movement in the direction shown by the arrow 22. The outer cylindrical surface 32 is formed of compliant material such as an elastomeric material having a thickness of approximately one-half inch. The grinding wheel 16 in such known arrangements, therefore, will engage the outer surface 32 while imparting a stress that deforms the outer surface 32. The deformation can be appreciated by measuring post-grind spring back, which is illustrated by a dimension 36 shown in FIG. 5. Overbuild portion 34 is the amount of material sought to be removed during the grinding operation.

Figure 6:
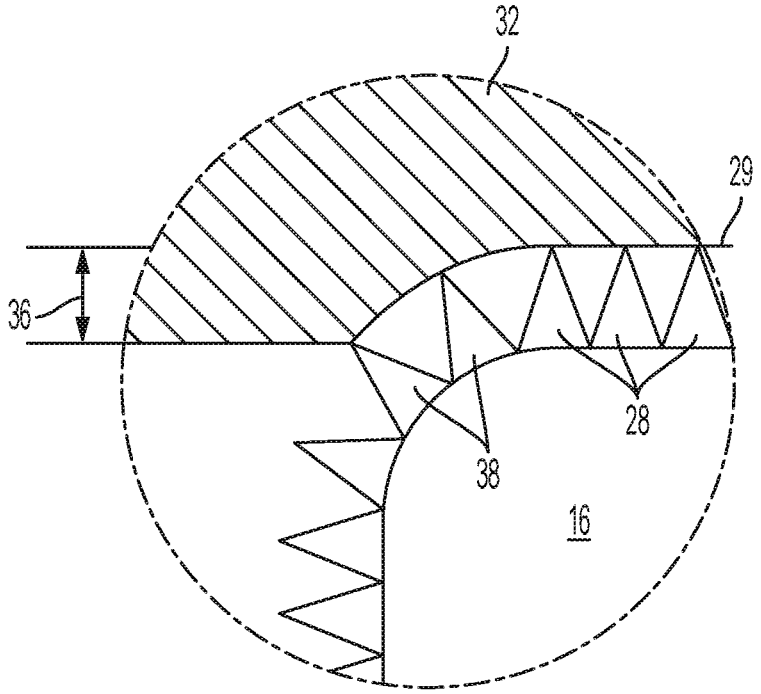
FIG. 6 is an expanded cross section view taken from FIG. 5, illustrating a limitation of the prior art as the work piece relaxes from being worked.

FIG. 6 is an exploded view of the phenomena that has been discovered as a result of the work performed on the feed roller 32. As the stress of grinding is relieved, the outer cylindrical surface 32 grows by dimension 36 as it returns to an unstressed condition. The coating 28 of grinding wheel 16 which has been dressed to define working plane 29 will typically produce a smooth surface on compliant material 32. The undressed portion of coating 28 which extends from the working plane 29 can produce irregularities on the surface of compliant material 32 as it comes in contact therewith post-grind. Specifically, one or more undressed pinnacles 38, 38 shown in FIG. 6 may contact the recently finished ground surface of compliant material 32. Such contact causes surface irregularities in the form of scratches.

Figure 7:
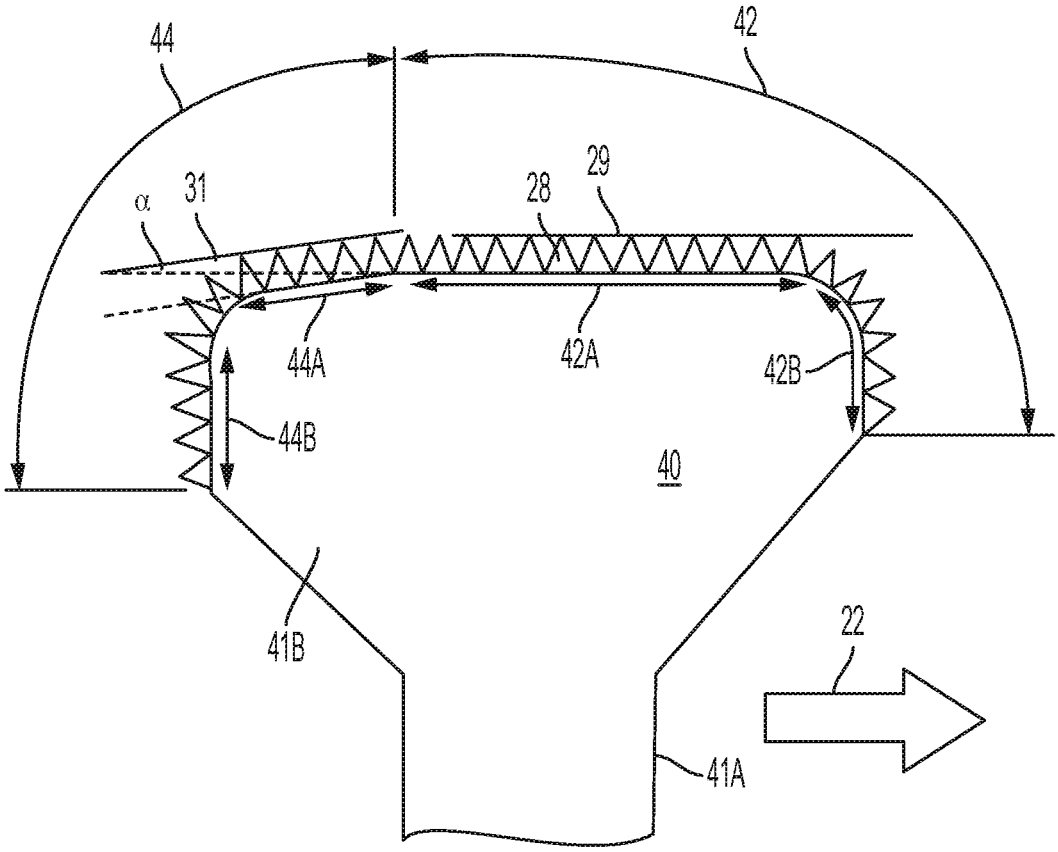
FIG. 7 is a cross section view of a grinding wheel according to the present disclosure.
Figure 8A:
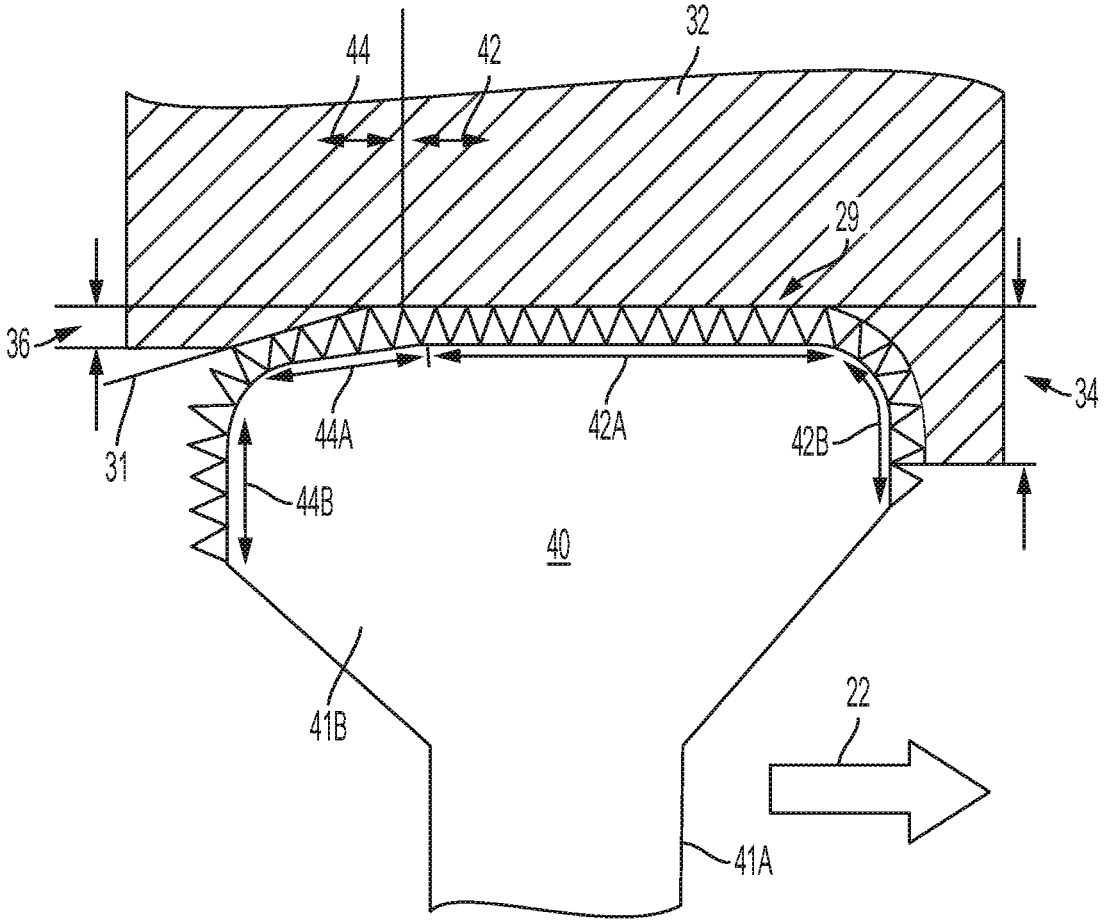
FIG. 8A is a cross-section view of the grinding wheel shown in FIG. 7 engaged with a work piece during a grinding operation.

FIGS. 7 and 8 show one preferred embodiment of the present invention. As shown therein, a grinding wheel 40 comprises a hub 41A and an outer rim 41B. The outer rim 41B generally forms a right circular cylinder having an outer surface that includes a first profile portion 42 and a second profile portion 44. The first profile portion 42 and the second profile portion 44 present disparate surface profiles relative to each other. In the illustrated embodiment, the grinding wheel 40 may by CNC machined to define the base for the first profile portion 42 and the second profile portion 44 on which the abrasive coating 28 will be applied as will be understood by those skilled in the art.

The first portion 42 is defined by a relatively planar axially extending segment 42A that is covered by abrasive coating 28 having a grit that is selected to produce a desired finish while grinding the roller surface 32. The abrasive coating 28 is dressed to define a first working surface 29. The first portion 42 also includes a side segment 42B that forms the leading edge of the grinding wheel outer surface. In this regard, the side segment 42B includes a radius proximate to its intersection with the relatively planar axially extending segment 42A. As explained in greater detail below, the side segment 42B may be, but is not required to be, dressed.

The second profile portion 44 has a first relatively planar segment 44A that is characterized by a radially inwardly extending taper, from the perspective of travel of the grinding wheel relative to the feed roller outer surface. As with the first profile portion 42, the first segment 44A of the second profile portion 44 is also covered by abrasive coating 28. In this case, the first segment 44A of the second profile portion 44 is dressed to define a second generally planar working surface 31. The second profile portion 44 also includes a side segment 44B that defines a trailing surface for the grinding wheel. As with side segment 42B, the second side segment 44B includes a radius proximate to its intersection with the first segment 44A of the second profile portion 44. As explained in greater detail below, the side segment 44A is dressed in a preferred embodiment to avoid scratches and the like to form on the work piece after it has been finished.

Figure 8B:
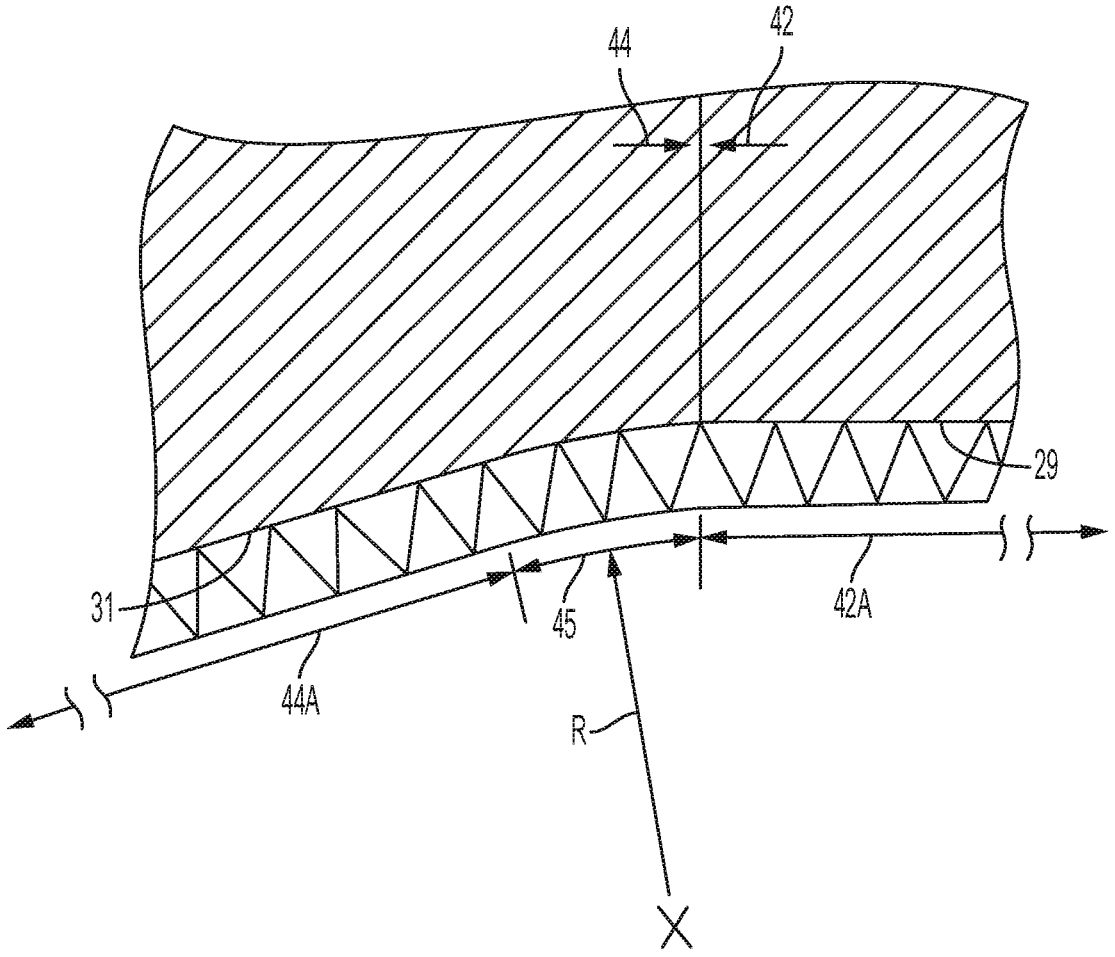
FIG. 8B is a partial cross-section view of the grinding wheel shown in FIG. 8A illustrating in greater detail a transition between a first working surface and a second working surface according to one embodiment.

The second working surface 31 is oriented relative to the work piece at a face angle chosen to be different from the first working surface, and intersects the first working surface at a line defined by the transition of the first and second working surfaces. As shown in FIG. 7, the angle $\alpha$ defined between the first working surface 29 and the second working surface 31 may be approximately 1.22 degrees in a preferred embodiment. In the preferred embodiment, a transition region 45 defined by a generous radius terminates at a tangent with the first working surface 29 and at a tangent with the second working surface 31, as shown in FIG. 8B. For example, a 12-inch radius may be used to define the transition region 45 to smooth the transition between the working surfaces in a preferred embodiment.

Figure 8C:
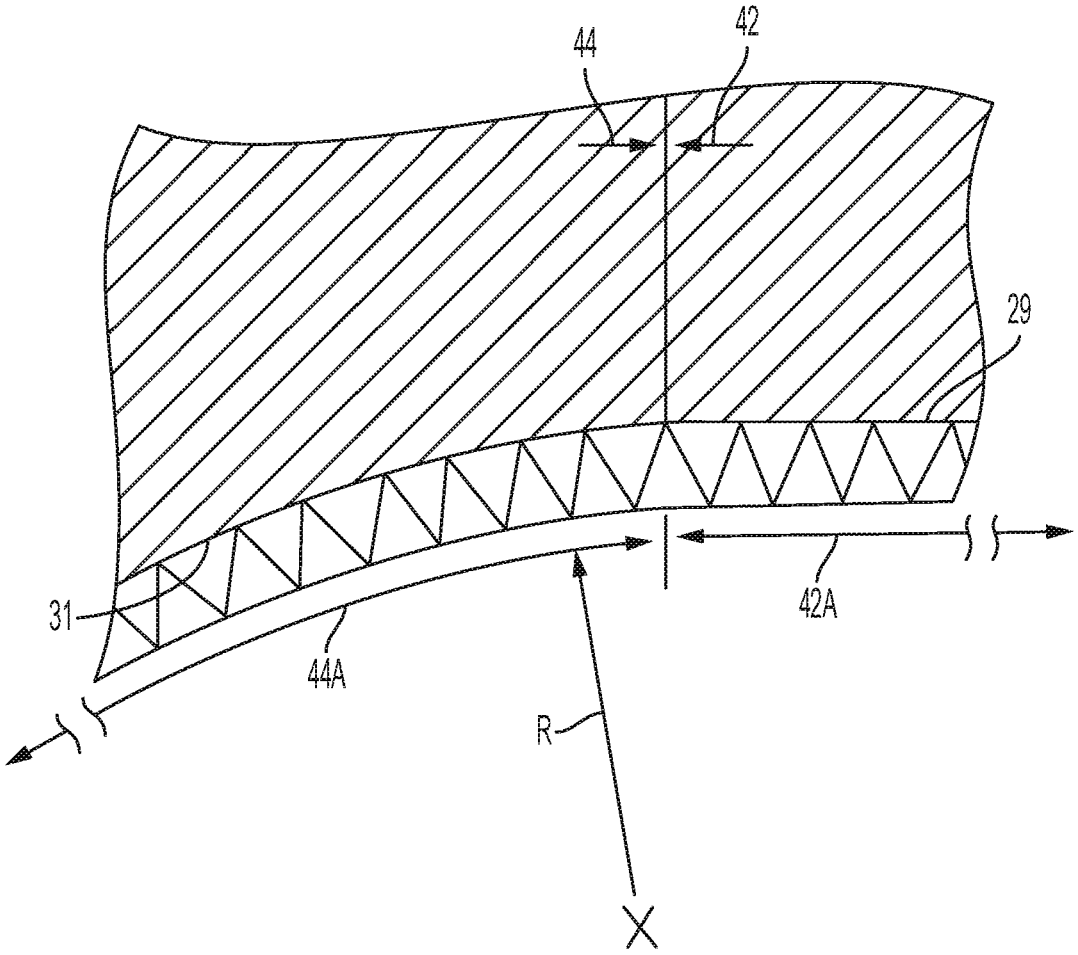
FIG. 8C is further partial cross-section view of the grinding wheel shown in FIG. 8A illustrating in greater detail a transition between a first working surface and a second working surface according to a second embodiment.
Figure 9:
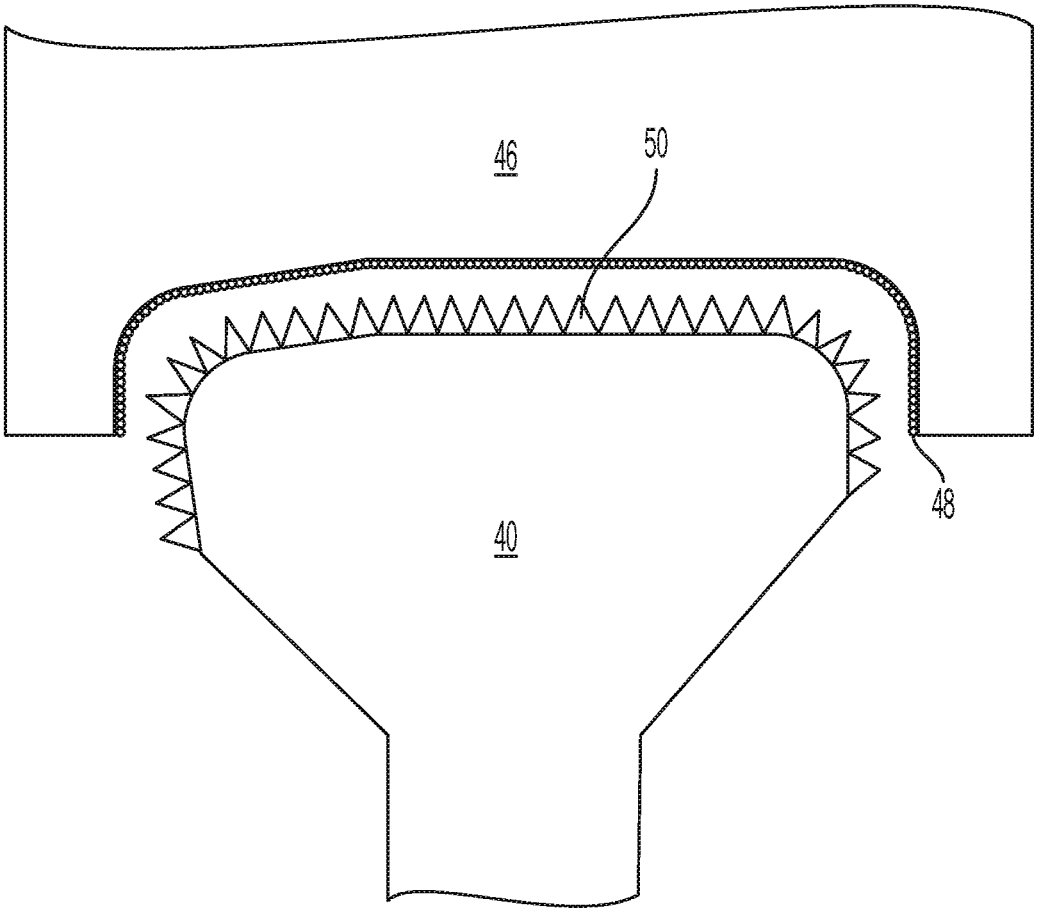
FIG. 9 is a cross section view of a final operation for preparing the grinding wheel for production.

In a second embodiment, the second working surface 31 itself is defined by a generous radius, such as a 12-inch radius illustrated in FIG. 8C. As shown therein, the second working surface 31 terminates at a tangent with the first working surface 29 such that the second working surface 31 defines a smooth transition with the first working surface 29. In this way, the second working surface 31 tapers away from the finished ground surface or first working surface 29 either along a straight line (FIG. 8B) or along a curved path defined as a radius (FIG. 8C).

The amount of radial inward taper of the second working surface 31 relative to the first working surface 29 is chosen as a function of the elasticity of the material being worked. Therefore, for performing a dressing operation on a relatively compliant material such as material chosen for a web roller outer cylindrical surface, which has a hardness of approximately 40 Shore A, the working surface 31 tapers radially inwardly by 0.015 inches at its maximum. By contrast, the working surface 31 has a radial inward taper of approximately 0.008 inches to perform a dressing operation on a less compliant material, such as a polyurethane material having a hardness of approximately 85 Shore A. In this case, the axial length of the second working surface 31 may also be reduced as the material being worked undergoes less post-grind spring back as compared with more compliant material.

As explained above, the grinding wheel 40 in the illustrated embodiment is preferably 12 inches in diameter. The outer rim 41B has a width of two inches between the facing sides 42B, 44B. The second profile portion 44 extends radially inwardly by 0.008 inches at its maximum. The first working surface 29 and the second working surface 31 intersect at the line which is approximately 0.375 inches from the side face 44B.

FIG. 8 shows the grinding wheel 40 operating in a controlled fashion to remove overbuild from the work piece 32. In this case, the work piece 32 is a paper feed roller in which the outer cylindrical surface is made of a compliant material. The amount of overbuild removed is shown in FIG. 8 by the dimension 34. As grinding wheel 40 moves axially relative to the work piece in the direction of arrow 22, the overbuild material is removed and the surface is finished by the first work surface 29 defined by the grinding wheel. During this finishing operation, the outer cylindrical surface of the work piece is deformed radially inwardly as it is ground along the first working plane 42A. The amount of compression of the outer cylindrical surface is shown in FIG. 8 by the dimension 36.

Because it is relieved radially inwardly in a progressive fashion, the second working surface 31 defined by the second profile portion 44 accommodates post grind expansion of the outer cylindrical surface 32 of the work piece. Stated differently, the second profile portion 44 tapers radially inwardly toward its downstream end to accommodate the feed roller outer surface as it relaxes from the deformed shape it has taken during the finishing operation along the first working surface 29. The amount of taper for the second work surface 31 may be determined by approximation of the relaxation characteristics of the work piece. That is, for worked materials having greater elasticity, the amount of taper for the second working surface 31 is increased to allow controlled relaxation of the worked material. Advantageously, this arrangement provides a relatively constant abrasive finishing surface as the work piece expands.

FIGS. 9-12 show various manufacturing steps for dressing the grinding wheel 40 in an illustrated embodiment. In this case, the grinding wheel 40 is dressed using a 120-140 grit diamond dressing wheel 46. The dressing wheel 46 is rotated on a shaft (not shown) disposed parallel to the central axis of grinding wheel 40. The dressing wheel 46 is formed with an inverted shape of the work surface for the grinding wheel 40. The dressing wheel 46 is rotated in such a manner that when diamond coating 48 is brought into contacting relation with the abrasive coating 50 disposed on grinding wheel 40, the abrasive coating 50 is ground to the profile defined by dressing wheel 46.

Figure 10:
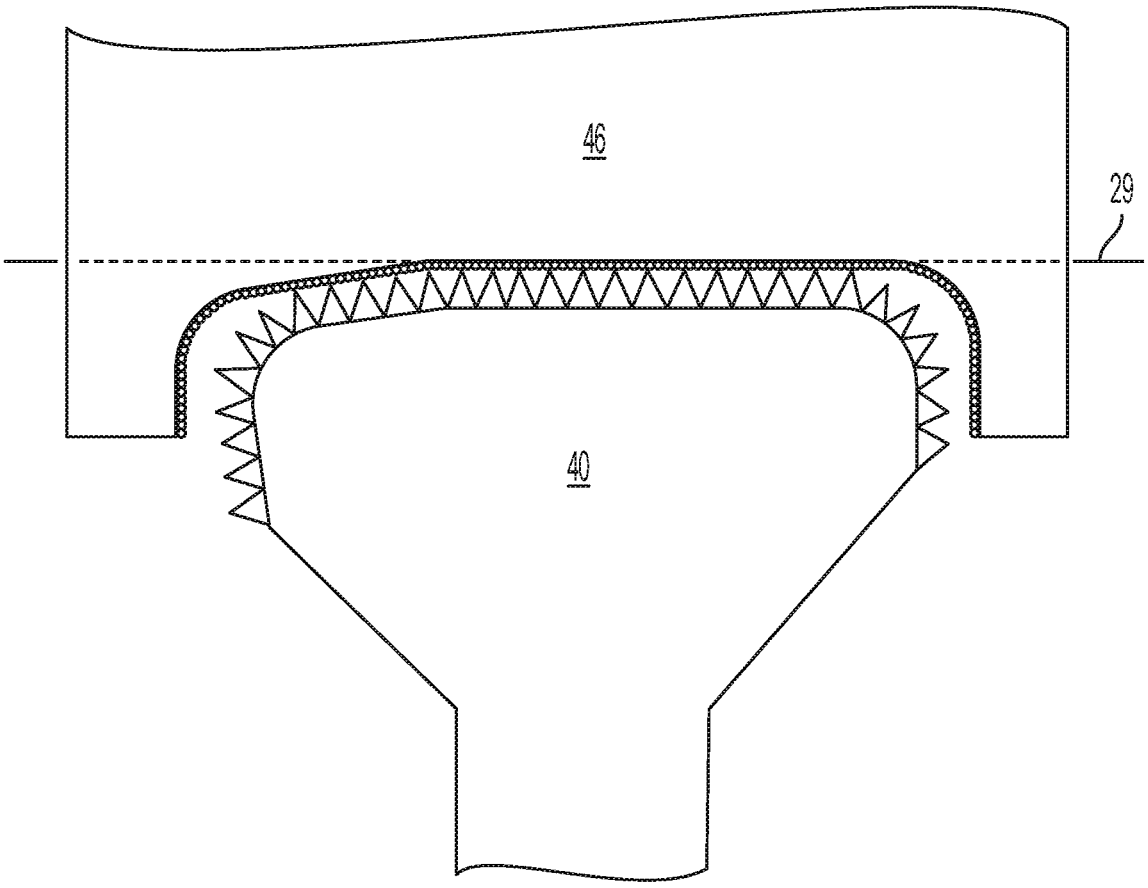
FIG. 10 is a cross section view of a dressing wheel engaged with the abrasive coating of the present disclosure to prepare it for production.
Figure 11:
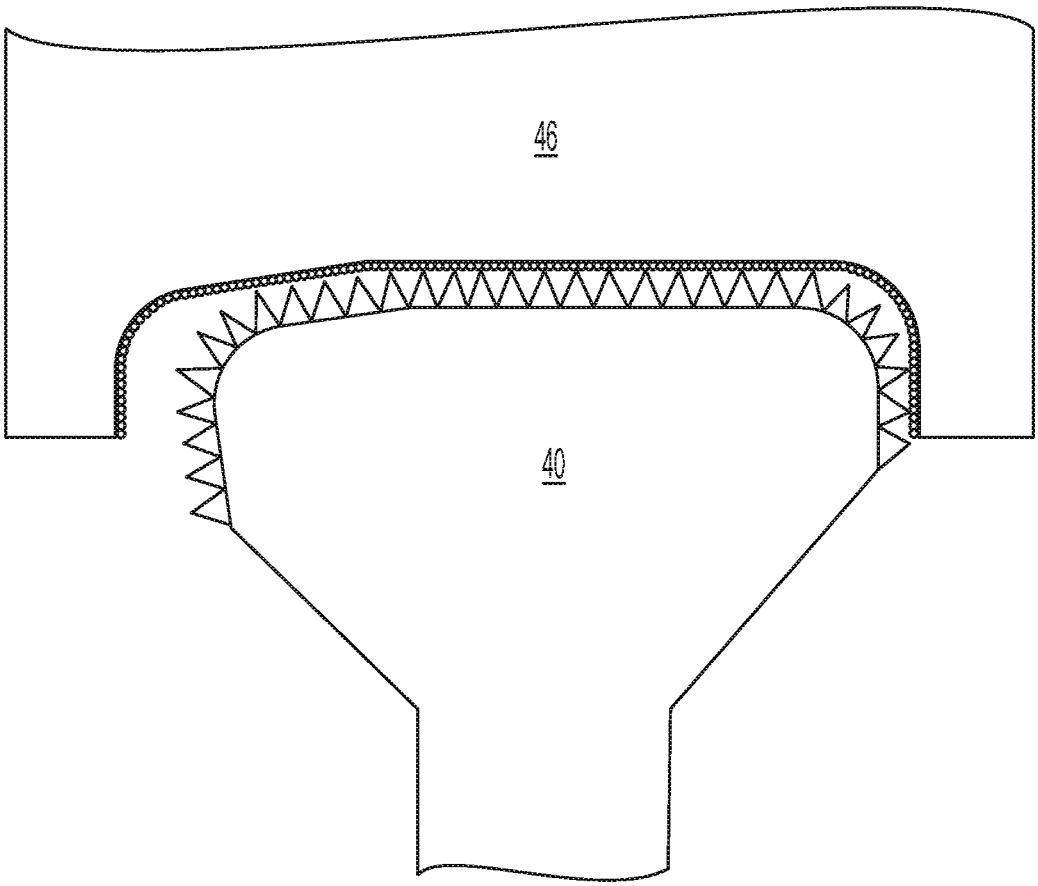
FIG. 11 is a cross section of the dressing wheel shown in FIG. 10 engaged with the right radius of the abrasive coating of the present disclosure.
Figure 12:
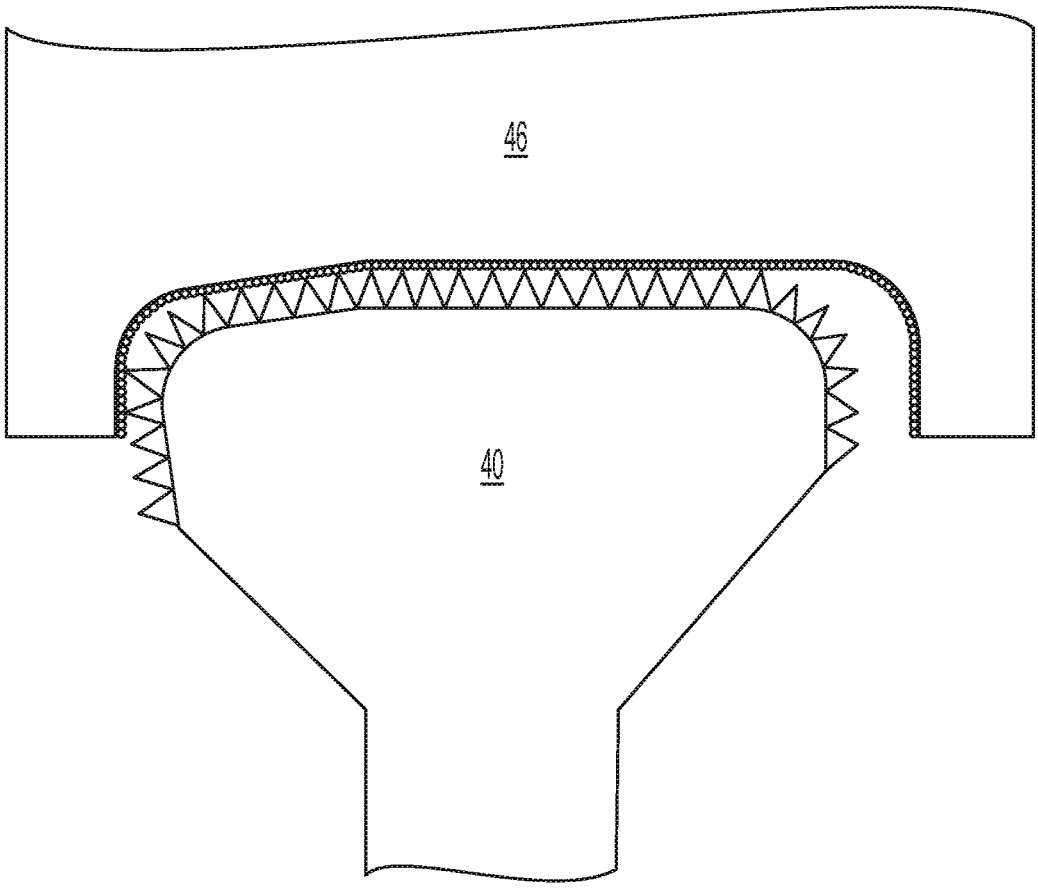
FIG. 12 is a cross section of a dressing wheel engaged with the left tapered portion of the coating of the present disclosure.

As shown in FIGS. 10-12, the grinding wheel working surfaces are dressed according to a series of plunges in which the dressing wheel 46 forms the first working surface 29 and the second working surface 31 (see FIG. 8) for the grinding wheel. As shown in FIG. 10, the dressing process includes first a plunge in which the first working surface 29 is ground. In dressing operations performed according to prior art methods, a grinding wheel dressing operation would typically conclude by dressing this single planar surface.

Unlike known grinding wheel dressing methodologies, the grinding wheel 40 next makes a relative axial shift to the right, as shown in FIG. 11. In this operation, the first working surface 29 together with the remaining segment of the first profile portion 42B (see FIG. 7) are dressed. Finally, the grinding wheel makes a relative axial shift to the left so that the first working surface 29 and second working surface 31 are dressed, together with the trailing edge segment 44B of the second profile portion 44, as shown in FIG. 12. In this manner abrasive coating 50 applied to grinding wheel 40 is made uniform across the entire profile. That is, unlike prior art dressing operations, the entire profile of the first and second profile portions 42 and 44 are dressed, including the trailing edge segment 44B of the second profile portion 44. In this way, the grinding wheel of the present disclosure avoids forming scratches or other imperfections on the work piece surface being finished as it relaxes from a grinding operation.

Various advantages flow from the disclosure as set forth herein. For example, the grinding wheel has a greater ability to produce a uniform finish to the work piece, without scratching or other imperfections caused by the expansion of the worked material contacting undressed portions of the grinding wheel. Moreover, the dimensions of the work-piece surface can be more closely controlled as a grinding wheel according to this disclosure traverses along its path.

Those skilled in the art will recognize that certain details shown in the foregoing specification and drawings are exemplary in nature and may be modified without departing from the teachings of the disclosure. All such modifications and variations that basically rely on the teachings through which the invention has advanced the art are properly considered within the spirit and scope of the invention, as defined by the following claims.

The invention claimed is:

1. An abrasive tool including a tool base have a supporting surface and an abrasive surface layer located on the supporting surface, wherein the abrasive surface layer is generally cylindrical and rotatable about a central axis for removing material from the outer surface of a work piece by abrasive contact therewith and by relative movement thereof along a working path having a pre-defined direction of relative travel between the abrasive tool and the work piece, the pre-defined direction of relative travel being parallel to and spaced from the abrasive tool axis, the abrasive tool comprising:

(a) a first axially extending circumferential portion including an abrasive coating selected to produce a final finish on the work piece outer surface, the first axially extending portion defining a first generally planar working surface; and (b) a second axially extending circumferential portion, located downstream of the first axially extending portion, and disposed to remove material from the work piece only after removal therefrom by the first axially extending circumferential portion, the second axially extending circumferential portion including an abrasive coating selected to produce a final finish on the work piece outer surface, the second axially extending circumferential portion defining a second generally planar working surface that tapers radially inwardly by a dimension that accommodates post-grind radial expansion of the work piece outer surface as the abrasive tool and work piece move in the pre-defined direction of relative travel.

2. The abrasive tool of claim 1 wherein said first generally planar working surface and said second generally planar working surface form an acute angle at their intersection.

3. The abrasive tool of claim 1 wherein said first generally planar working surface and said second generally planar working surface are dressed.

4. The abrasive tool of claim 1 wherein the tool base has a diameter of approximately 12 inches and wherein second working surface has a taper dimension of approximately 0.008 inches relative to the first working surface.

5. The abrasive tool of claim 4 wherein the second working surface forms a radius of at least 12 inches.

6. An abrasive tool comprising:

a rotatable tool base with a supporting surface being generally cylindrical and rotatable about a central axis, the tool being adapted to remove material from the outer surface of a work piece by abrasive contact therewith and by relative movement thereof along a working path having a pre-defined direction of relative travel between the abrasive tool and the work piece, the pre-defined direction of relative travel being parallel to and spaced from the abrasive tool axis;

an abrasive surface layer located on the supporting surface including a first axially extending circumferential portion including an abrasive coating selected to produce a final finish on the work piece outer surface, the first axially extending portion defining a first generally planar working surface; and a second axially extending circumferential portion, located downstream of the first axially extending portion, and disposed to remove material from the work piece after removal therefrom by the first axially extending circumferential portion, the second axially extending circumferential portion including an abrasive coating selected to produce a final finish on the work piece outer surface, the second axially extending circumferential portion defining a second generally planar working surface that tapers radially inwardly by a dimension that accommodates post-grind radial expansion of the work piece outer surface as the abrasive tool and work piece move in the pre-defined direction of relative travel.

7. A method for making an abrasive tool including the steps of:

(a) forming a tool base defining an outer supporting cylindrical surface presenting a first axially extending circumferential portion and a second axially extending circumferential portion relative to a desired direction of travel, located adjacent to the first axially extending portion;

(b) applying an abrasive surface layer to the first and second axially extending portion to provide first and second axially extending abrasive surfaces;

(c) applying a first dressing operation to the first axially extending circumferential abrasive portion to define a first relatively planar working surface; and (d) thereafter applying a second dressing operation to the second axially extending circumferential abrasive portion to define a second working surface that tapers radially inwardly relative to the first working surface by a dimension that accommodates post-grind radial expansion of the work piece outer surface.

8. The method of claim 7 further including:

(a) forming a trailing edge for the abrasive tool base relative to the desired direction of travel adjacent to the second axially extending circumferential portion;

(b) applying an abrasive surface layer to the trailing edge;

(c) applying a dressing operation to the trailing edge.

9. The method of claim 8 wherein the step of applying a dressing operation to the abrasive tool trailing edge occurs during the application of the second dressing operation to the second axially extending circumferential abrasive portion.

* * * * *